US011490655B2

(12) United States Patent
Somers

(10) Patent No.: US 11,490,655 B2
(45) Date of Patent: Nov. 8, 2022

(54) TANK PROTECTOR FOR A VAPORIZER CARTRIDGE

(71) Applicant: Joseph Somers, Whitestone, NY (US)

(72) Inventor: Joseph Somers, Whitestone, NY (US)

( * ) Notice: Subject to any disclaimer, the term of this patent is extended or adjusted under 35 U.S.C. 154(b) by 0 days.

(21) Appl. No.: 16/849,259

(22) Filed: Apr. 15, 2020

(65) Prior Publication Data

US 2020/0345067 A1 Nov. 5, 2020

Related U.S. Application Data

(60) Provisional application No. 62/841,402, filed on May 1, 2019.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 40/40*** | (2020.01) |

(52) U.S. Cl.
CPC ..... *A24F 40/40* (2020.01)

(58) Field of Classification Search
CPC ..... A24F 13/14; A24F 40/40; A24F 7/00
See application file for complete search history.

(56) References Cited

U.S. PATENT DOCUMENTS

| | | | | |
|---|---|---|---|---|
| 4,638,819 | A * | 1/1987 | Ikeda | A24D 1/12 131/331 |
| 4,703,766 | A * | 11/1987 | Wargo | A24F 13/16 131/349 |
| 5,558,452 | A * | 9/1996 | Oka | B43K 23/008 D19/903 |
| D735,935 | S * | 8/2015 | Burrell | D27/186 |
| 9,764,093 | B2 * | 9/2017 | Weikart | C23C 16/402 |
| D801,579 | S * | 10/2017 | Nyaggah | D27/183 |
| 10,219,541 | B2 * | 3/2019 | Rado | A24F 40/42 |
| 10,264,817 | B2 * | 4/2019 | Haun | A24F 42/60 |
| 10,980,280 | B2 * | 4/2021 | Morningstar | A24F 9/16 |
| 2004/0091302 | A1 * | 5/2004 | Yokouchi | B43K 23/008 401/6 |
| 2016/0213062 | A1 * | 7/2016 | Doyle | A45F 5/02 |
| 2017/0105451 | A1 * | 4/2017 | Fornarelli | A24F 40/42 |
| 2017/0119044 | A1 * | 5/2017 | Oligschlaeger | H02J 7/0044 |
| 2018/0064171 | A1 * | 3/2018 | Verleur | A61M 11/042 |
| 2020/0154788 | A1 * | 5/2020 | Novak, III | G05B 15/02 |
| 2020/0170295 | A1 * | 6/2020 | Grimm | A24F 13/00 |
| 2021/0086219 | A1 * | 3/2021 | Hsiao | A61L 9/14 |

* cited by examiner

*Primary Examiner* — Abdullah A Riyami
*Assistant Examiner* — Thang H Nguyen
(74) *Attorney, Agent, or Firm* — Boudwin Intellectual Property; Daniel Boudwin

(57) ABSTRACT

A vaporizer cartridge and tank guard including an elongated member. The long member is a cylindrical member. The long member has a vertical hole located through a middle section. The interior of the hole is surrounded by a flexible material. This material allows a glass cartridge or tank to be removably secured within the hole. A second material is placed around the flexible material. The second material is a hard, protective material that prevents the cylinder from being crushed. The long member has an ergonomic exterior. This exterior is created by tapering the long member inward at the center.

5 Claims, 3 Drawing Sheets

TANK PROTECTOR FOR A VAPORIZER CARTRIDGE

CROSS REFERENCE TO RELATED APPLICATIONS

This application claims the benefit of U.S. Provisional Application No. 62/841,402 filed on May 1, 2019. The above identified patent application is herein incorporated by reference in its entirety to provide continuity of disclosure.

BACKGROUND OF THE INVENTION

The present invention relates to vaporizer cartridge and tank guards. More particularly, the present invention provides an elongated cylindrical member made with a hard exterior and a flexible gripping interior to protect a vaporizer cartridge or tank.

Many people used to enjoy smoking cigarettes or other various herbs. Recently, a new trend has taken hold. Instead of smoking the leaves from various plants in order to ingest the chemicals and receive the desired effects, there has a been a movement toward reducing them to liquid forms. The proper chemicals are extracted from the plants and added to a liquid. The liquid is then heated and applied to air forming a steam like mixture which can then be inhaled into the lungs. This will prevent extra smoke particles from being inhaled.

In order to create this steam mixture to allow the chemicals to be inhaled, special devices have been created. These devices are called vaporizers or vapes. The vaporizers include heating coils, battery packs, and tanks or cartridges. There are many different types of tanks and cartridges. Many of the tanks are made from glass. These tanks can be fragile and can be easily broken. This can cause a vaporizer to become useless and require a costly repair. If the tanks are broken more than just the tank can be destroyed.

Consequently, there is a need in for an improvement in the art of protecting a vaporizers cartridge or tank. The present invention substantially diverges in design elements from the known art while at the same time solves a problem many people face when attempting to protect their vaporizers cartridge or tank. In this regard the present invention substantially fulfills these needs.

SUMMARY OF THE INVENTION

The present invention provides a vaporizer cartridge and tank guard wherein the same can be utilized for providing convenience for the user when carrying a vaporizer around or using it. The vaporizer cartridge and tank protector comprise an elongated first member. In one embodiment member is an elongated cylindrical member. The elongated member has a hole located vertically therethrough. The elongated member is made from a hard foam.

Another object of the present invention is to allow a user to better be able to handle a vaporizer by providing an elongated member having an ergonomic design.

Another object of the present invention is to allow the vaporizer cartridge and tank protector to removably secure a glass tank or cartridge within the vertical hole.

Another object of the present invention is a vaporizer cartridge and tank protector comprising an elongated cylindrical member. The elongated cylindrical member is made from a plurality of layers. A first interior layer is made up of a soft flexible material. A second exterior layer is made up of a hard, protective layer. The elongated member has a hole located vertically therethrough, such that the first layer is exposed therein.

Another object of the present invention is the second layer is made from a hard foam.

Another object of the present invention is the first layer is made from a flexible rubber.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

LIST OF REFERENCE NUMERALS

Figure 1:
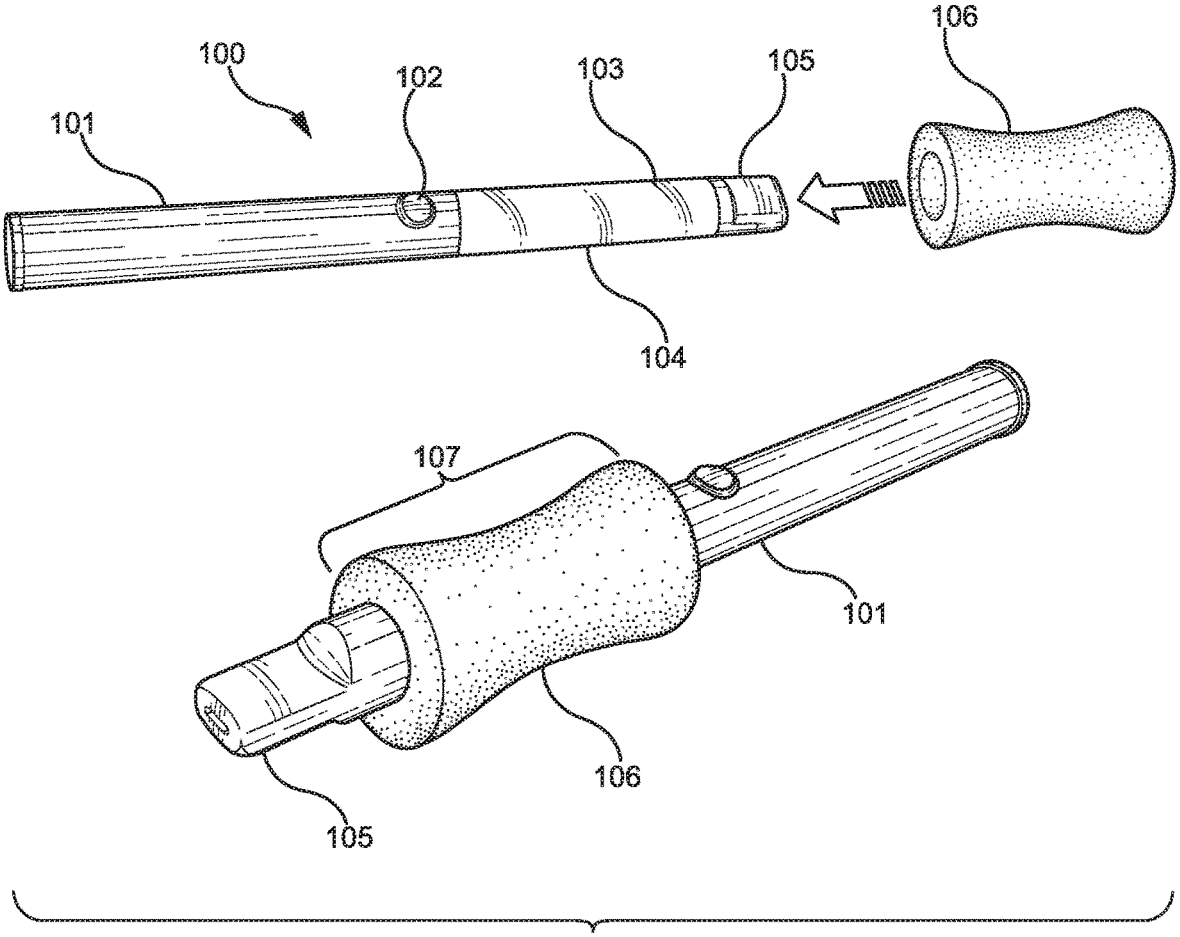
FIG. 1 shows a perspective view of an embodiment of the vaporizer cartridge and tank guard.

With regard to the reference numerals used, the following numbering is used throughout the drawings.

100 Vaporizer
101 Housing
102 Activation Button
103 Liquid container
104 Atomizer
105 Mouthpiece
106 Liquid container guard
107 Ergonomic design
201 A diameter of the hole
202 Thickness of the liquid container guard
203 Hole of the liquid container guard
301 First material of the liquid container guard
302 Second material of the liquid container guard

DETAILED DESCRIPTION OF THE INVENTION

Reference is made herein to the attached drawings. Like reference numerals are used throughout the drawings to depict like or similar elements of the vaporizer cartridge and tank guard. For the purposes of presenting a brief and clear description of the present invention, a preferred embodiment will be discussed as used for the vaporizer cartridge and tank guard. The figures are intended for representative purposes only and should not be considered to be limiting in any respect.

Referring now to FIG. 1, there is shown a perspective view of an embodiment of the vaporizer cartridge and tank guard. For the duration of this specification cartridges, tanks, or other items used to hold vaporizing liquids are referred to as liquid containers. Many vaporizers have similar parts. A vaporizer 100 typically has a housing 101 with the ability to have parts added thereto. The housing holds a battery to power the vaporizer 100. Further, an activation button 102 is located within the housing 101. Vaporizers 100 have a liquid container 103 which can be attached to the housing 101. The liquid container 103 is typically made from plastic or glass. Tanks 103 that are often made from glass are easily broken. Further, tanks usually contain an atomizer 104 to turn the liquid inside into a vapor. Atomizers can be expensive and difficult to replace. Finally, a mouthpiece 105 is attached to the tank 103 for a user to inhale the vapor from. Since the liquid container 103 is made from a thin glass a guard is needed for the liquid container 103.

The liquid container guard 106 is made to fit over a vaporizer 100. The liquid container guard 106 can be in a variety of sizes and lengths to fit all varieties of liquid container. In one embodiment, the liquid container guard 106 has a small length and a large width. In another embodiment, the liquid container guard 106 has a large length and a small width. The liquid container guard 106 is designed to fit between the housing 101 and the mouthpiece 105. This will ensure that the liquid container 103 is protected, and the vaporizer 100 is still usable with the cartridge or tank guard 106 attached.

In one embodiment, the cartridge or tank guard 106 has an ergonomic design, shown by 107. In one embodiment, the ergonomic feature 107 is a tapered middle section. This means that the ends of the liquid container guard 106 will have a larger width than the middle section. In one embodiment, the cartridge or tank guard 106 tapers toward the middle. This ergonomic feature 107 will make the liquid container guard 106 easy to hold while in use, such that a user is less likely to drop the vaporizer 100.

Figure 2:
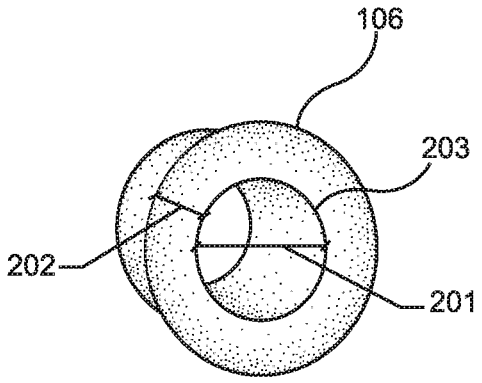
FIG. 2 shows a top perspective view of an embodiment of the vaporizer cartridge and tank guard.

Referring now to FIG. 2, there is shown a top perspective view of an embodiment of the vaporizer cartridge and tank guard. There is a hole 203 that goes all the way through the center of the liquid container guard 106. This hole is longitudinally placed in the liquid container guard 106. The liquid container guard 106 has a diameter 201 that will allow the liquid container guard 106 to fit over a liquid container of a vaporizer. The liquid container guard 106 can have a varying diameter to fit different size tanks or cartridges.

Further, there is a thickness 202 between the interior of the liquid container guard 106 and the exterior of the liquid container guard 106. This thickness has the ability to change and support the ergonomic grip as earlier described. Further, the thickness may change based on the composition of the liquid container guard 106 as described below. Further, this thickness is impacted by the diameter of the hole 203. The hole 203 may have different diameters in order to fit different liquid containers.

Figure 3:
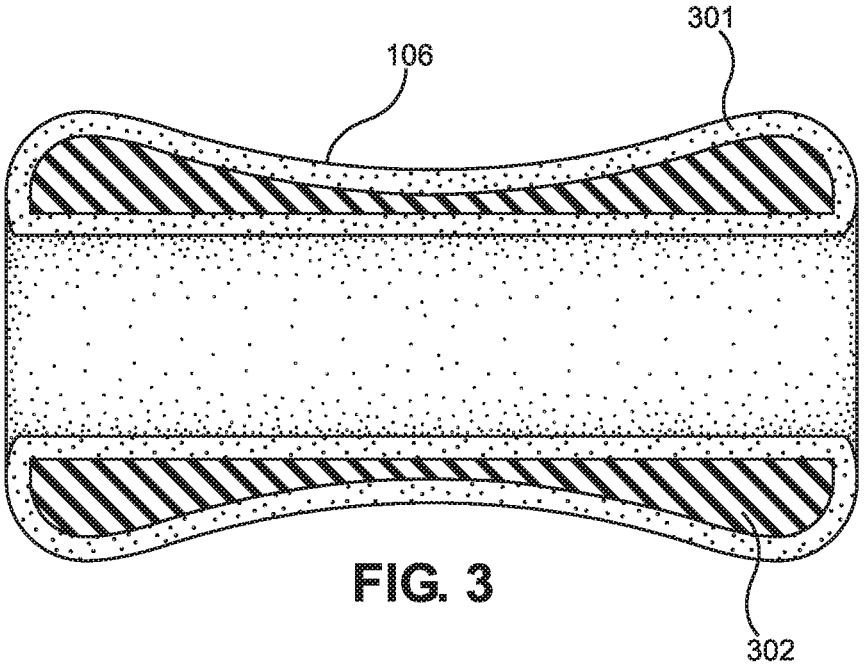
FIG. 3 shows a cross-sectional view of an embodiment of the vaporizer cartridge and tank guard.

Referring now to FIG. 3, there is shown a cross-sectional view of an embodiment of the vaporizer cartridge and tank guard. In one embodiment, the liquid container guard 106 is made from a first material 301. This first material 301 shall be a hard material that is crush resistant. The first material may be a plastic, metal fiberglass or other suitable material. The first material 301 can make up the entirety of the cartridge or tank guard 106. In another embodiment, the liquid container guard 106 is made entirely from a second material 302. The second material 302 shall be made from a flexible shock resistant material. In one embodiment, the second material 302 is rubber. In one embodiment, the second material 302 is made from a gel. The second material 302 is capable of removably securing a glass or plastic material. The second material 302 is a high friction material to prevent movement.

In one embodiment, the first material 301 and the second material 302 are used together. In this embodiment, the first material 301 is the external material. This first material 301 provides a crush resistant outer shell. Further, in this embodiment, the second material 302 is placed as an internal layer and contacts the liquid container guard 106. In this embodiment, the second material 302 is a shock resistant material to prevent the tank from breaking upon impacts.

Figure 4:
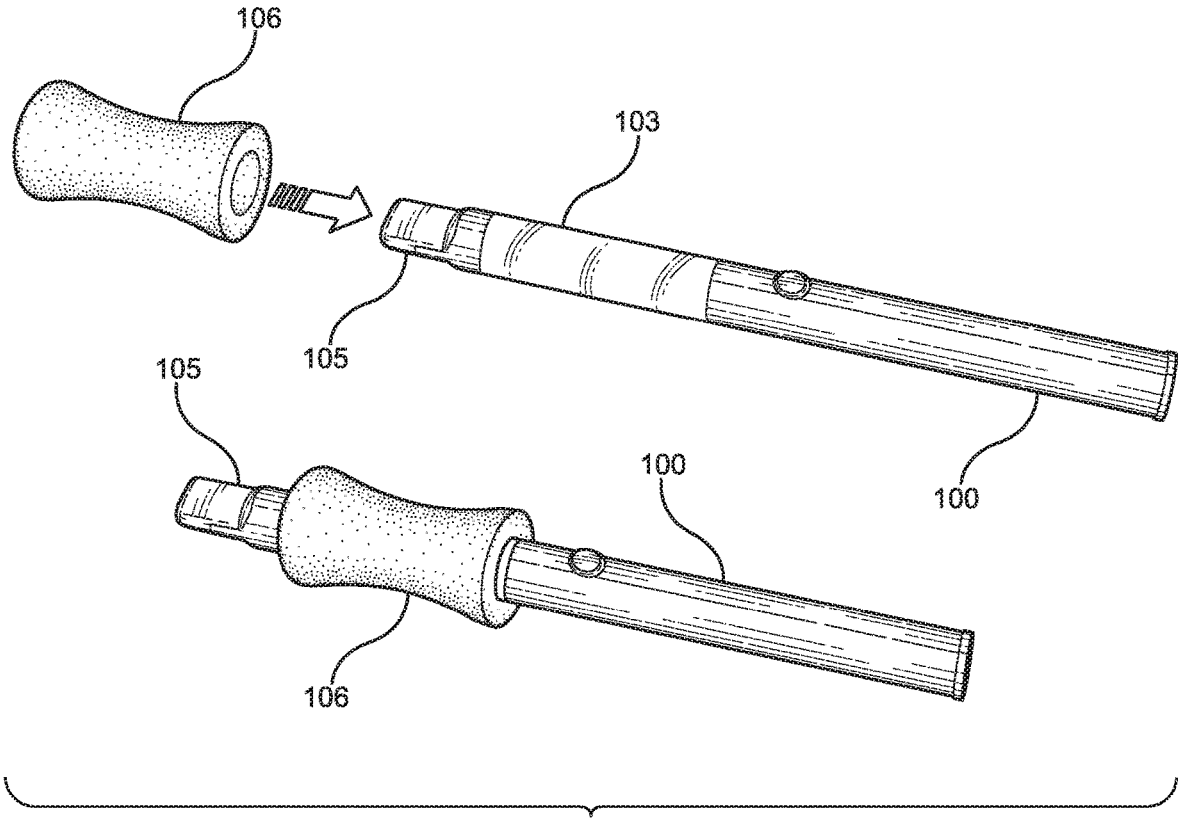
FIG. 4 shows an in-use view of an embodiment of the vaporizer cartridge and tank guard.

Referring now to FIG. 4, there is shown an in-use view of an embodiment of the vaporizer cartridge and tank guard. The liquid container guard 106 is designed to be easily installed. The liquid container guard 106 is designed to be able to slide over the mouthpiece 105 and onto the tank or cartridge 103. In one embodiment, the guard 106 is held onto the tank 103 by the interior material. This material will allow the cartridge or tank guard 106 to be placed onto the tank 103 by sliding it onto the vaporizer 100 and held in place. Once the liquid container 103 is placed inside of the liquid container guard 106 the liquid container 103 will be protected by the guard 106. Further, in some embodiments the user will have a better grasp of the device due to the liquid container guard 106. This will better ensure the device is not dropped during use.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tank protector for a vaporizer cartridge, the tank protector comprising:

an elongated cylindrical member;

the elongated cylindrical member being made from a plurality of layers;

a first layer is made up of a soft flexible material;

a second layer is made up of a protective layer;

wherein the elongated member further comprises a hole disposed longitudinally therethrough, such that the first layer is exposed therein;

wherein the hole extends through an entire length of the elongated member between a first end of the elongated member and a second end of the elongated member;

wherein the first layer is disposed about an entire interior surface of the hole;

wherein the first layer is continuous over the interior surface of the hole and an exterior surface of the elongated member, such that the second layer is fully encompassed by the first layer.

2. The tank protector for a vaporizer cartridge of claim 1, wherein the second layer is made from a hard foam.

3. The tank protector for a vaporizer cartridge of claim 2, wherein the first layer is made from a flexible rubber.

4. The tank protector for a vaporizer cartridge of claim 1, wherein the elongated member is tapered inward at a center such that a thickness at the center of the elongated member is less than at the first and second ends.

5. The tank protector for a vaporizer cartridge of claim 4, wherein the elongated cylindrical member is tapered inward at the center to provide the ergonomic design.

* * * * *